8-107 SR
FIP8309 XR 4,115,057

United States Patent [19]
DeFeo et al.
[11] 4,115,057
[45] Sep. 19, 1978

[54] PROCESS FOR THE DYEING OF FIBROUS MATERIALS CONTAINING BASIC FUNCTIONS IN DYEING BATHS BASED ON ORGANIC SOLVENTS

[75] Inventors: Francesco DeFeo; Vincenzo Gemini, both of Milan; Luigi Floridia, Florence, all of Italy

[73] Assignee: Montedison S.p.A., Milan, Italy

[21] Appl. No.: 736,511

[22] Filed: Oct. 28, 1976

[30] Foreign Application Priority Data

Oct. 30, 1975 [IT] Italy ..... 28832 A/75

[51] Int. Cl.[2] ..... D06P 3/06; D06P 3/24; D06P 1/39; D06P 5/00

[52] U.S. Cl. ..... 8/54; 8/169; 8/172 R; 8/85 R; 8/1 S; 8/107; 8/174; 8/94 A

[58] Field of Search ..... 8/169, 177 AB, 172 R, 8/85 R, 1 S, 174, 54

[56] References Cited

U.S. PATENT DOCUMENTS

| | | | |
|---|---|---|---|
| 3,297,695 | 1/1967 | Weidinger et al. | 8/169 |
| 3,846,070 | 11/1974 | Langmann et al. | 8/172 R |
| 3,954,399 | 5/1976 | Nemoto et al. | 8/172 R |

FOREIGN PATENT DOCUMENTS

| | | | |
|---|---|---|---|
| 643,838 | 2/1964 | Belgium | 8/1 S |
| 227,648 | 4/1908 | Fed. Rep. of Germany. | |
| 1,241,899 | 8/1971 | United Kingdom. | |

OTHER PUBLICATIONS

Nemoto, Y et al. Update '1973 AATCC Symposium 1973, pp. 58–64.
Color Index, vol. 2 1971, p. 2005.

*Primary Examiner*—Joseph L. Schofer
*Assistant Examiner*—Maria S. Tungol
*Attorney, Agent, or Firm*—Morgan, Finnegan, Pine, Foley & Lee

[57] ABSTRACT

The present invention concerns a dyeing process with acid dyes for fibrous materials having basic functions, characterized in that amines are used which form salts or complexes with the dyes and have the general formula:

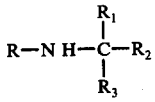

(I)

wherein:

$R_1$, $R_2$ and $R_3$ are aliphatic hydrocarbon radicals, saturated or unsaturated, and having a linear or branched chain;

R is either hydrogen or an aliphatic hydrocarbon radical, with either a linear or branched chain, saturated or unsaturated, on the general condition that the sum of the carbon atoms of the radicals $R_1$, $R_2$, $R_3$ and R be a whole number between 11 and 29.

More particularly, this invention relates to the use of dyeing baths based on preferably chlorinated organic solvents, containing salts or complexes of organic dyes, containing carboxylic and/or sulphonic groups, with aliphatic amines of a selective liquid anion-exchanger character wherein a primary or secondary nitrogen atom is bound to a tertiary alkyl radical for the dyeing of nitrogen-containing fibres.

6 Claims, No Drawings

PROCESS FOR THE DYEING OF FIBROUS MATERIALS CONTAINING BASIC FUNCTIONS IN DYEING BATHS BASED ON ORGANIC SOLVENTS

BACKGROUND OF THE INVENTION

German Pat. No. 277,648 of Apr. 28, 1908 discloses a process using a dyeing bath based on organic solvents such as hydrocarbons, carbon tetrachloride, and the like.

Italian Pat. No. 872,658 discloses a dyeing process for fibrous materials containing —NH— groups, characterized in that the dyeing is carried out with solutions based on chlorinated hydrocarbons containing aminic salts or aminic adducts of the acid dyes with amines containing at least eight carbon atoms and showing an uninterrupted chain of at least three carbon atoms.

However, it has been found experimentally that with the amines disclosed in the above said Italian patent it is not possible to obtain dyeings with an intensity greater than 2–3% of dye on the weight of the fibre, with commercially acceptable exhaustion rates of the dyeing baths.

This is also confirmed by what was ascertained and maintained by V. Yoshio Nemoto et al. in: "Dyeing Of Wool And Nylon With Complexes Of Acid Dyes With Amines From Organic Solvents," that is, that the above-described known method "contains many problems difficult to overcome before it can be used successfully" (see text: Solvent Technology — Update '73 AATCC — American Association of Textile Chemistry and Colorists — Symposium 1973, pages 58–64).

Moreover, it is known that the longer the hydrocarbon chain of the amine, and thus the higher the solubility in an organic solvent of the complex with acid dye, the smaller will be the degree of exhaustion (see Yoshio Nemoto, loc. cit.)

In the prior art there is not disclosed the use of salts or complexes of acid dyes with aliphatic amines, in which the primary or secondary nitrogen atom be combined with a tertiary alkyl radical.

OBJECTS OF THE INVENTION

It is an object of this invention to provide an improved dyeing process for fibrous materials containing basic functions. A further object of this invention is to provide an improved dyeing process which provides a dyeing bath having a high concentration of dye while also permitting a desirable exhaustion rate of the dyeing bath. A further object of this invention is to provide fibrous materials dyed in accordance with the improved process of this invention.

Other objects of the invention will be apparent from the discussion which follows:

SUMMARY OF THE INVENTION

Process for dyeing with acid dyes fibrous materials containing basic functions in baths based on organic solvents characterized in that the baths contain aliphatic amines having the general formula:

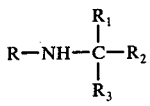

(I)

wherein:

R is hydrogen or a saturated or unsaturated, aliphatic hydrocarbon radical with a linear or branched chain; and where $R_1$, $R_2$, $R_3$ are saturated or unsaturated aliphatic hydrocarbon radicals with either a linear or branched chain, and the sum of the carbon atoms of radicals R, $R_1$, $R_2$ and $R_3$ is a number comprised between 11 and 29.

GENERAL DESCRIPTION OF THE INVENTION

Now it has surprisingly been observed that amines having at least one tertiary alkyl bound to the N of the amine group, although having a very high solubility in solvents, and thus supplying solutions with a high concentration of dye, display contemporaneously exceptional exhaustions of the dyeing baths even at high concentrations which, in particular for synthetic polyamide fibres, attain saturation values of 4–5% of dye on the weight of the fibre.

It was possible to obtain these surprisingly results thanks to the peculiar characteristics as anion-exchangers of these amines containing a tertiary alkyl bound to the N; since with the anion exchangers it is possible to obtain very high selectivities in ion exchange and interexchange.

It should be kept in mind that, given the particular characteristics of these ion-exchanging amines, having, that is, the property of effecting an immediate exchange, one has through them the possibility to intervene during dyeing in order to obtain total and gradual exhaustions of the bath by suitably varying the pH.

Said variations of the pH may be obtained by the addition of suitable quantities of organic acids such as, for instance, acetic acid, formic acid, dodecylbenzensulphonic acid and/or anionic surfactants in the acid state, that is, with the acid functions in all of them or partly not salified. The above said organic acids are conveniently utilized in quantities that range from 0.5% to 5%, but preferably are comprised between 1% and 3% on the weight of the fibre.

The best dyeing results are obtained with mixtures of dodecylbenzensulphonic acid and acid phosphoric esters of condensed ethylene oxide and of a condensed fatty alcohol, such as, for instance, the commercial product Tensagap $XA_3$, in a wide range of ratios varying from 1:4 to 2:1, but preferably in the ratio of 1:2.

A further advantage represented by this invention consists in its substantial contribution in solving the ecological or environment problem, bound to the treatment of the discharge waters: this is made possible thanks to the high degree of exhaustion attainable for the bath and to the possibility of regeneration of the liquid amine exchangers.

The dyeing baths may be prepared by cold dissolution in chlorinated solvents of the salts or of the complexes of the dyes with the amines used in accordance with the invention.

As organic solvents, preferably chlorinated, may be used, for instance: the chlorinated aliphatic and aromatic hydrocarbons with boiling points comprised between 50° and 180° C, such as, for instance: perchloroethylene, trichloroethylene, 1,1,1-trichloropropane, methylene chloride, chlorobenzene and chlorotoluene. However, particularly suited for the purpose have proved to be perchloroethylene and trichloroethylene.

The salts or complexes between the acid dyes and the amines may be prepared according to various conventional methods. Thus, for instance, an aqueous solution of acid dye in the form of sodium salt is acidified to 2–3 pH with mineral acid (e.g.: $H_2SO_4$, HCl) and then extracted with a solution containing the equivalent weight of liquid anion exchanger amine in a halogenated hydrocarbon solvent. As a rule, each acid group of the dye contains at least a chemical equivalent of the chosen aliphatic amine, and more precisely from 1 to 1.2 equivalents.

After separation of the aqueous phase, the organic phase contains the dissolved salt or complex and, depending on the need, may be diluted or concentrated at will.

According to an alternative method, it is possible to add to the dyeing solution, acidified as indicated above, the specially chosen amine dissolved in alcohol, therafter evaporating the solvent and dissolving again the salt or the complex with the chlorinated solvent.

Examples of dyes useful in the process of this invention are the groups of series of organic dyes described in the color index, falling under the general denominations of: acid dyes, metallized or unmetallized, direct dyes, acid reactive dyes. More particularly, there are used azoic, anthraquinonic, stylbenic, quinophthalonic, phtalocyaninic and metinic dyes, containing carboxylic and/or sulphonic groups. As basic components of the above-described salts or complexes, there are used aliphatic amines having selective characteristics of liquid anion exchangers comprised by the general formula (I) described herein earlier.

The aiphatic amines of general formula (I) may be completely insoluble in the aqueous phase and at the same time must be regeneratable by means of ionic exchange or interexchange wherefore they are almost quantitatively recoverable.

As liquid anion exchanger amines, available on the market and particularly suited for the purpose, may be indicated for instance: N-dodecenyl-(trialkyl-methyl) amine having from 24 to 28 carbon atoms (Amberlite LAI ®), N-Lauryl-(trialkyl-methyl) amine having from 24 to 28 carbon atoms (Amberlite ®), and the primary trialkyl-methyl-amines having from 12 to 22 carbon atoms such as, for instance, the Primene 81-R ® (mainly consisting of from t-$C_{12}$-$H_{25}$-$NH_2$ up to t-$C_{14}H_{20}$-$NH_2$) and the Primene JM-T ® (mainly consisting of from t-$R_{18}H_{37}$-$NH_2$ up to t-$C_{22}H_{45}$-$NH_2$). (See Helfferich in: *Ion Exchange,* McGraw-Hill Book Co., Inc., 1962, page 584).

The chemical-physical characteristics of the amines to which is bound a tertiary alkyl and having hydrocarbon chains with at least 12 carbon atoms, are directly linkable particulaly to the tertiary alkyl group which imparts to them a high solubility in the organic solvents, at the same time making them completely insoluble in water, so much so as to make them fall under the definition of liquid anion exchangers.

To the bath may be conveniently added small quantities of water, duly emulsified with non-ionic emulsifiers and/or mixtures non-ionic and anionic emulsifiers or other polar solvents.

The quantity of water may vary, depending on the fibres and on the desired tintorial intensities, from 5% to 60%, and that of the emulsifier from 1% to 15% on the weight of the fibre.

As non-ionic emulsifiers may be conveniently used mixtures of these in order to obtain an optimal Hydrophilic Lypophilic Balance (HLB) for obtaining a water-/oil emulsion, provided that these mixtures be soluble or finely dispersable in the dyeing bath.

The dyeing temperature shall be comprised between 60° and 120° C, depending on the nature of the fibre and of the dyes. The dwelling times at dyeing temperature are comprised between 20 and 40 minutes.

Finally, it must be kept in mind that, according to the process of this invention, there may be dyed fibrous materials containing basic functions and particularly —NH—, and —$NH_2$— groups, such as for instance: natural polyamides such as wool and silk, synthetic polyamides such as poly-ε-caprolactam, polyhexamethylene-adipamide or the product of the polycondensation of the -Ω-amino-undecanoic acid, Qiana ®, polyurethane fibres and other fibres of various chemical composition, provided they show a modification of a basic nature, and with the general limitation that said fibrous materials obviously will not be altered or dissolved by the solvents used.

The present process may also be applied to optical bleaching of the textile fibres containing basic functions, by using salts or complexes of amines with an optical bleaching agent having an acid function.

SPECIFIC DESCRIPTION OF THE INVENTION

The applicational examples that follow hereunder just serve to illustrate the invention without, however, limiting the scope of the invention itself.

The parts and percentages are to be understood as expressed by weight, when not otherwise indicated.

EXAMPLE 1

100 parts of a fabric of polyamide 66 were immersed at room temperature in a dyeing bath consisting of: 1.77 parts of the salt of Amberlite LA2/ dye C.I. Acid YELLOW 39 (corresponding to 2 parts of a commercial dye at a standard concentration of 100%); 10 parts of emulsified water with 2 parts of an emulsifier consisting of: 15.9% of Tween 80 ® (commercial product based on sorbitane monooleate condensed with 20 mols of ethylene oxide) and 84.1% of Span 80 ® (commercial product based on monooleatesorbitane), both produced by Atlas; 3200 parts of commercial perchloroethylene.

The temperature was then brought in 15 minutes up to 100° C in a closed apparatus and maintained at 100° C for 30 minutes.

The bath was then cooled down and discharged and the fabric was washed in a lukewarm perchloroethylene bath. Thereby was obtained a bright yellow dyeing of good equalization and with a bath exhaustion of 92% and with fastnesses comparable to those obtainable from an aqueous bath.

The same dyeing, carried out by using the salt of dye C.I. Acid Yellow 39 with a primary linear $C_{16-18}$ amine, gave an exhaustion of 13%.

EXAMPLE 2

100 parts of an unshrinkable hosiery were immersed at room temperature into a dyeing bath consisting of: 2.5 parts of the salt Amberlite LA2/Dye C.I. Acid Red 57 (corresponding to 3 parts of dye at 100% standard tinctorial concentration), 40 parts of water emulsified with 8 parts of an emulsifier consisting of 15.9% of Tween 80 and 84.1% of Span 80, 1 part of commercial dodecylbenzensulphonic acid, 2 parts of Tensagap X-$A_3$ ® (a synthetic anionic surfactant based on an acid phosphoric ester of a condensate of ethylene oxide and of a fatty alcohol and 3200 parts of commercial perchloroethylene.

The temperature was brought up in 20 minutes to 100° C in a closed apparatus and maintained at 100° C for 45 minutes. Thereupon the material was washed in lukewarm perchloroethylene and then was dried.

A dyeing was obtained having a good penetration and a good general fastness. The bath was essentially exhausted.

EXAMPLE 3

100 parts of polyamide 66 yarn were immersed at room temperature into a dyeing bath consisting of: 0.84 parts of the salt Amberlite LA2/Dye C.I. Acid Red 57 (corresponding to 1 part of the dye at 100% of standard tinctorial concentration), 28 parts of mother emulsion consisting of: 79 parts of perchloroethylene, 17.5 parts of water, 3.5 parts of the emulsifier described in the preceding example; 1600 parts of commercial perchloroethylene.

The temperature was brought up to 100° C in 15 minutes in a closed apparatus, and was maintained at that level for 30 minutes.

The material was taken out of the bath and dried. There was a 100% exhaustion of the dyeing bath.

EXAMPLE 4

100 parts of hosiery consisting of: 80% by weight of polyamide 6 and 20% by weight of LYCRA ® (a polyurethanic fibre) were immersed at room temperature into a dyeing bath consisting of: 2.66 parts of the Amberlite LA2/Dye C.I. Acid Blue 117 No. 17,055 (corresponding to 2 parts of dye at 100% standard tinctorial concentration), 10 parts of emulsified water with 2 parts of emulsifier consisting of: 15.9% of Tween 80 and 84.1% of Span 80, 1 part of icy acetic acid and 4800 parts of commercial perchloroethylene.

The temperature was brought up to 90° C in 20 minutes in a closed apparatus and was maintained at that level for 45 minutes.

The material was then taken out from the bath and washed with perchloroethylene. There was obtained a good covering of both fibres. This dye is not usable in the exhaustion dyeing in aqueous bath for this kind of blend.

EXAMPLE 5

100 parts of satin fabric of Nylon 66 were introduced at room temperature into a dyeing apparatus with under pressure circulating bath, fitted with an under pressure reactant feeding device, containing a bath consisting of: 7.05 parts of the salt of Amberlite LA2/C.I. Acid Black 164 dye (1:2 premetallized dye) corresponding to 7.5 parts of dye at 100% standard tinctorial concentration; 20 parts of emulsified water with 4 parts of an emulsifier consisting of 15.9 parts of Tween 80 and 84, 1 part of Span 80, 3600 parts of commercial perchloroethylene.

Thereupon the temperature was rapidly raised, in 15 minutes to 100° C and was then maintained at this temperature for 10 minutes; then, in the following 30 minutes of dyeing, into the apparatus were introduced in gradual doses 3 parts of sodium acetate.

The bath was then cooled down, the fabric was taken out and repeatedly washed with lukewarm perchloroethylene, and then dried.

A black dyeing of good intensity, excellent equalization and good fastnesses was obtained. The bath exhaustion amounted to 85%.

EXAMPLE 6

100 parts of Nylon 66 staples were immersed at room temperature into a dyeing bath consisting of: 0.84 parts of salt Amberlite LA2/dye C.I. Acid Yellow 76, No. 18,850 (corresponding to one part of the dye at 100% of standard tinctorial concentration; 1600 parts of commercial perchloroethylene and possibly one part of emulsifier like that of the preceding example in case of high humidity of the perchloroethylene.

Thereupon the temperature was brought up in 15 minutes to 95° C in the closed apparatus, and was then maintained at that level for 30 minutes.

The material was then taken out of the apparatus, was washed in lukewarm perchloroethylene and finally dried. The exhaustion was 98%. The same test, carried out at the same tinctorial concentration with the salt of the same dye salified with Imidrol OH ® (product based on 2-hepta-decyl-1-(2-hydroxyethyl)-2-imidazoline), gave a bath exhaustion of 50%.

A dyeing carried out under the same conditions, but with 1.68 parts of the Amberlite LA2/Dye C.I. Acid Yellow 76 salt, No. 18,850 (corresponding to 2 parts of dye at 100% of standard tinctorial concentration), gave a bath exhaustion of 75%, while the salt of said dye with the Imidrol OH gave an exhaustion of 30%.

Carrying out the dyeing as described above, but with the addition of 5 parts of emulsified water as in the preceding examples, in the case of Amberlite LA2, there was attained a bath exhaustion of 97% and, in the case of the Imidrol OH salt, there was obtained a 50% exhaustion.

EXAMPLE 7

100 parts of Nylon 66 fabric were immersed at room temperature into a bath consisting of the following salts: 1.07 parts of salt Amberlite LA2/Acid YELLOW 65 No. 14,170 (corresponding to 1.2 parts of dye at 100% of standard tinctorial concentration), 1.05 parts of Amberlite LA2/Acid Red 118 (corresponding to 1.4 parts of dye at 100% of standard tinctorial concentration), 0.62 parts of the Amberlite LA2/Acid Blue 113 C.I. No. 20,360 (corresponding to 0.6 parts of dye at 100% of standard tinctorial concentration), 10 parts of water emulsified with the emulsifier of the preceding example and 1600 parts of commercial perchloroethylene.

The temperature was then brought in 20 minutes up to 100° C in a closed apparatus, and was maintaned at this temperature for 45 minutes. On completion of the dyeing, the bath was quickly cooled down and removed. There was obtained a fabric with a brown dyeing suited for umbrellas and showing a good color intensity and good general fastnesses. The bath exhaustion was almost total.

EXAMPLE 8

1500 parts of stretched Nylon 66 (Filanca) were introduced at room temperature into a rotating tumbler containing: 48,000 parts of commercial perchloroethylene additioned with: 30 parts of the emulsifier described in the preceding example.

The material was shaken through the tumbler for about 5 minutes in order to wet it uniformly with the solvent. Then there were added: 850 parts of mother emulsion as in Example 3. Thereupon there were added 21.65 parts of Amberlite LA2/Dye C.I. Acid Blue 25, No. 62,055 salt (corresponding to 30 parts of dye at 100% of standard tinctorial concentration).

Thereupon the temperature was brought up in 10 minutes to 85° C and was maintained there for another 30 minutes. On completion of the dyeing, the material was centrifuged for 2 minutes, then into the apparatus was introduced fresh perchloroethylene and the material was washed for 4 minutes, centrifuged for 3 minutes and then dried in the same apparatus for 15 minutes.

There was obtained a bright blue dyeing of excellent general fastnesses and with a bath exhaustion of 93%. The dyed material was an unscoured crude material, since the scouring is carried out in the dyeing stage.

EXAMPLE 9

100 parts of unshrinkable wool yarn were immersed at room temperature into a bath containing: 1.18 parts of Amberlite LA2/Dye C.I. Acid Red 85, No. 22,245 salt (corresponding to 1.5 parts of the dye at 100% of standard tinctorial concentration); Setrolene O® (a commercial product based on sorbitane monooleate with 20 mols of ethylene oxide); Setrol O® (a commercial product based on sorbitane-monooleate); 20 parts of water emulsified with 5 parts of an emulsifier consisting of: 15.9% of Setrolene O and 84.1% of Setrol O; 2 parts of Tensagap $XA_3$ (a synthetic anionic surfactant based on an acid phosphoric ester of a condensate of ethylene oxide and a fatty alcohol); 1 part of dodecylbenzensulphonic acid; 1440 parts of commercial trichloroethylene.

The temperature was then raised in 30 minutes to 100° C in a closed apparatus and maintained at this temperature for 60 minutes.

Once the dyeing was completed the bath was removed and the material was dried. There was obtained a dyeing of good penetration with an excellent bath exhaustion.

EXAMPLE 10

100 parts of polyamide 6 (ε-caprolactam) were introduced at room temperature into a dyeing bath containing: 2.38 parts of Amberlite LA2/Dye C.I. Acid Red 85, No. 22,245 salt (corresponding to 3 parts of dye at 100% of standard tinctorial concentration), 2 parts of water emulsified with: 1.25 parts of emulsifier consisting of 15.9% of Tween 80 and 84.1% of Span 80, 1440 parts of trichloroethylene.

The temperature was then raised in 15 minutes to 95° C in the closed apparatus and maintained at this level for 45 minutes. Thereupon the bath was removed and the material was dried. There was obtained a scarlet red dyeing of good fastnesses and with a bath exhaustion of 98.4%.

EXAMPLE 11

100 parts of hosiery of polyamide 6 (ε-caprolactam) were immersed at room temperarture into a dyeing bath consisting of: 1.07 parts of Amberlite LA2/Dye C.I. Acid Blue 40, No. 62,125 salt (corresponding to 2 parts of dye at 100% of standard tinctorial concentration), 5 parts of water emulsified with 1.25 parts of emulsifier of the preceding example, 1600 parts of commercial perchloroethylene.

The temperature was then raised in 15 minutes to 85° C in the closed apparatus and maintained at that level for 45 minutes.

Thereupon the bath was removed and the material as washed with perchloroethylene and then dried.

There was obtained a dyeing of a greenish blue tinge of good fastnesses and with a bath exhaustion of 90%.

EXAMPLE 12

100 parts of a Nylon 66 fabric were immersed at room temperature into a dyeing bath consisting of: 1.67 parts of Amberlite LA2/Dye C.I. Acid Red 57 salt (corresponding to 2 parts of the dye at 100% of standard tinctorial concentration), 10 parts of water emulsified with: 2 parts of the emulsifier of the preceding example; 3200 parts of commercial perchloroethylene.

The temperature was then raised in 30 minutes up to 100° C in the closed apparatus, and was then maintained at that level for 60 minutes. Once the dyeing was completed, the bath was removed and the material dried. There was obtained a bath exhaustion of 97%.

The same dyeing, carried out by using 1.5 parts of the salt of the C.I. Dye Acid Red 57 with the primary amine Noram S® (a product by firm Prochinor, based on a mixture of primary aliphatic linear amines having from 16 to 18 carbon atoms), supplies a bath exhaustion of scarcely 43%.

EXAMPLE 13

100 parts of Nylon 66 fabric was immersed at room temperature into a dyeing bath consisting of: 1.67 parts of the Amberlite LA2/Dye C.I. Acid Red 57 salt (corresponding to 2 parts of the dye at 100% of standard tinctorial concentration), 10 parts of water emulsified with: 2 parts of emulsifier of the preceding example, 2 parts of glacial acetic acid, 3200 parts of commercial perchloroethylene.

The dyeing was carried out according to the procedures described in Example 12. Thereby was obtained a bath exhaustion of 99.5%.

The same dyeing carried out using 1.50 parts of the salt of C.I. Acid Red 57 with a primary linear amine with $C_{16-18}$, gave a bath exhaustion of 50%.

If, on the contrary, under the same tinctorial conditions there is used the salt of C.I. Acid Red 57 with a secondary linear amine containing linear alkyl radicals with 14 carbon atoms, there will be obtained a bath exhaustion of 88%.

EXAMPLE 14

100 parts of a Nylon 66 fabric were immersed at room temperature into a dyeing bath consisting of: 0.57 parts of Amberlite LA2/Dye C.I. Acid Blue 82 salt (corresponding to 1 part of dye at 100% of standard tinctorial concentration), 3200 parts of commercial perchloroethylene.

Thereupon the temperature was raised in 20 minutes up to 100° C in the closed apparatus, and it was maintaned at that level for 30 minutes.

At this point the dyeing bath was removed and the fabric was washed in lukewarm perchloroethylene. There was obtained a dyeing of good general fastnesses and a bath exhaustion of 94% was attained.

The same dyeing, carried out using equivalent quantities of C.I. Acid Blue 82 with 2-(cyclohexylamino)-ethanol, gave a bath exhaustion of 78%.

EXAMPLE 15

100 parts of a polyamide 66 fabric were immersed at room temperature into a dyeing bath consisting of: 1.15 parts of the salt Amberlite LA2/Dye C.I. Acid Blue 82 (corresponding to 2 parts of the dye at 100% of standard tinctorial concentration), 10 parts of water emulsified with: 2 parts of the emulsifier of Example 10, 3200 parts of commercial perchloroethylene.

The temperature was then raised in 20 minutes to 100° C in the closed apparatus, and was maintained at this level for 30 minutes.

There was obtained a dyeing of good general fastnesses and with a bath exhaustion of 98%.

The same dyeing, carried out by using corresponding quantities of the salt of C.I. Acid Blue 82 with 2-(cyclohexylamino)-ethanol, gave a bath exahaustion of 78%.

EXAMPLE 16

100 parts of Nylon 66 yarn were immersed at room temperature into a dyeing bath containing: 0.98 parts of the salt Primene JM-T/Dye C.I. Acid Blue 25, No. 62,055 (corresponding to 1.5 parts of the dye at 100% of standard tinctorial concentration), 12.5 parts of water emulsified with: 2.5 parts of the emulsifier of Example 10, 2 parts of glacial acetic acid, 1600 parts of commercial perchloroethylene.

The temperature was then raised in 15 minutes to 100° C in the closed apparatus, and was then maintained at that level for 30 minutes. Thereby was obtained a dyeing of good general fastnesses.

EXAMPLE 17

100 parts of a fabric consisting of: 80% of polyamide 66 fibre and 20% of polyurethanic fibres, were immersed at room temperature into a dyeing bath consisting of: 0.98 parts of the salt Amberlite LA2/Dye C.I. Acid Yellow 25, No. 18,835 (corresponding to 1 part of the dye at 100% of standard tinctorial concentration), 5 parts of water emulsified with: 1 part of the emulsifier of Example 10, 3200 parts of commercial perchloroethylene.

Then the temperature was raised in 15 minutes up to 90° C and was maintained at this value for 45 minutes. Thereupon the dyeing bath was removed and the material was washed and dried. There was obtained a uniform yellow dyeing showing a satisfactory covering of the two fibres.

The fastenesses were comparable with those of the dyeing carried out starting from water.

EXAMPLE 18

100 parts of bulked polyamide 66 yarn were immersed at room temperature into a dyeing bath consisting of: 1.67 parts of the salt Amberlite LA2/Dye C.I. Acid Red 57 (corresponding to 2 parts of the dye at 100% of standard tinctorial concentration), 10 parts of water emulsified with: 2 parts of the emulsifier of Example 10, 3200 parts of commercial perchloroethylene.

The dyeing was carried out in a closed bath, bringing the temperature of the bath in 15 minutes up to 100° C and by then maintaining same at this level for 45 minutes. Thereafter the dyeing was removed and the material was washed and dried. There was obtained a bath exhaustion of 99%.

The Amberlite LA2/dye salt was prepared from the dye in the form of a free acid dispersed in distilled water, and then extracted with an equivalent solution of Amberlite LA2 in perchloroethylene.

What is claimed is:

1. A process for the dyeing of fibrous materials having basic functions which comprises dyeing said fibrous materials in a dye bath comprising an organic solvent, an acid dye, water, and emulsifying substance, an organic acid and an aliphatic amine having the general formula:

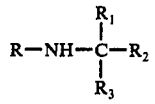

wherein:

R is hydrogen or a saturated or unsaturated aliphatic hydrocarbon radical with a linear or branched chain; and where $R_1$, $R_2$, and $R_3$ are saturated or unsaturated aliphatic hydrocarbon radicals with either a linear or branched chain, and the sum of the carbon atoms of radicals R, $R_1$, $R_2$, and $R_3$ is a whole number in the range from 11 to 29.

2. A process according to claim 1 wherein the organic solvent is a chlorinated solvent.

3. A process according to claim 1 wherein there are used acid dyes selected from the group consisting of azoic, anthraquinonic, stibenic, quinophthalonic, phtaloninic and metinic dyes, said dyes having groups selected from among carboxylic groups, sulphonic groups or both carboxylic and sulphonic groups.

4. A process according to claim 1 in which said amine is selected from among N-dodecenyl (trialkylmethyl) amine having from 24 to 28 carbon atoms, N-lauryl (trialkyl-methyl)-amine having from 24 to 28 carbon atoms and the primary trialkylmethyl amines having from 12 to 22 carbon atoms.

5. A process according to claim 1 in which water is present in quantities ranging from 5 to 60% with respect to the weight of the fibre, and the emulsifying substance is present in quantities ranging from 1% to 15% with respect to the weight of the fibre.

6. A process according to claim 1 in which the organic acid is selected from the group consisting of acetic, formic, dodecylbenzenesulphonic acid and anionic surfactants with non-salified acid functions.

* * * * *